US005551258A

United States Patent [19]

Rathbone

[11] Patent Number: 5,551,258

[45] Date of Patent: Sep. 3, 1996

[54] AIR SEPARATION

[75] Inventor: Thomas Rathbone, Farnham, England

[73] Assignee: The BOC Group plc, Windlesham, England

[21] Appl. No.: 563,554

[22] Filed: Nov. 28, 1995

Related U.S. Application Data

[63] Continuation of Ser. No. 356,096, Dec. 15, 1994, abandoned.

[51] Int. Cl.[6] ..... F25J 3/02

[52] U.S. Cl. ..... 62/646; 62/654

[58] Field of Search ..... 62/24, 38, 41

[56] References Cited

U.S. PATENT DOCUMENTS

| | | | |
|---|---|---|---|
| 3,210,951 | 10/1965 | Gaumer, Jr. | 62/29 |
| 4,208,199 | 6/1980 | Nakazato et al. | 62/29 |
| 4,410,343 | 10/1983 | Ziemer | 62/29 |
| 4,704,148 | 11/1987 | Kleinberg | 62/24 |
| 5,157,926 | 10/1992 | Guilleminot | 62/24 |
| 5,228,296 | 7/1993 | Howard | 62/24 |
| 5,251,449 | 10/1993 | Rottman | 62/41 |
| 5,263,327 | 11/1993 | Drnevich et al. | 62/24 |
| 5,379,598 | 1/1995 | Mostello | 62/38 |

FOREIGN PATENT DOCUMENTS 450768 10/1991 European Pat. Off. .

WO05893 8/1988 WIPO .

*Primary Examiner*—Ronald C. Capossela

*Attorney, Agent, or Firm*—David M. Rosenblum; Larry R. Cassett

[57] ABSTRACT

A stream of air is compressed in compressor and has water vapor and carbon dioxide removed therefrom in purification unit. A part of the resulting purified air is cooled by passage through heat exchanger and is employed to heat an intermediate reboiler in a lower pressure rectification column. The air flow from the reboiler passes into a higher pressure rectification column which supplies a stream of oxygen-enriched liquid air for separation in the lower pressure rectification column. Liquid nitrogen reflux for the higher pressure column is provided by taking nitrogen vapor from this column through an outlet and condensing it in another intermediate reboiler located above the reboiler in the lower pressure rectification column. The condensed nitrogen is returned to the top of the column. Another air stream is employed to reboil a further reboiler at the bottom of the lower pressure rectification column with the resulting condensed air stream being introduced into the higher pressure rectification column through an inlet. An impure oxygen product is withdrawn from the bottom of the lower pressure rectification column through outlet in liquid state and is vaporized in the heat exchanger. The arrangement of reboilers facilitates operation of the apparatus with a relatively low pressure ratio between the operating pressure of the higher pressure rectification column and that of the lower pressure rectification column.

23 Claims, 7 Drawing Sheets

AIR SEPARATION

This is a continuation of application Ser. No. 08/356,096 fled Dec. 15, 1994, now abandoned.

BACKGROUND OF THE INVENTION

This invention relates to a method and apparatus for separating air.

The most important method commercially for separating air is by rectification. A frequently used method of separating air by rectification includes steps of compressing a stream of air, purifying the resulting stream of compressed air by removing from it water vapor and carbon dioxide, and cooling the resulting purified stream of air by heat exchange with returning product streams to a temperature suitable for its rectification. The rectification is performed in a so-called "double rectification column" comprising a higher pressure and a lower pressure rectification column. Most if not all of the air is introduced into the higher pressure column and is separated into oxygen-enriched air and nitrogen vapor. Nitrogen vapor is condensed. Part of the condensate is used as liquid reflux in the higher pressure column. Oxygen-enriched liquid is withdrawn from the bottom of the higher pressure column, is sub-cooled and is introduced into an intermediate region of the lower pressure column through a throttling or pressure reduction valve. The oxygen-enriched liquid is separated into substantially pure oxygen and nitrogen products in the lower pressure column. These products are withdrawn from the lower pressure column and form the returning streams against which the incoming air is heat exchanged. Liquid reflux for the lower pressure column is provided by taking the remainder of the condensate from the higher pressure column, sub-cooling it, and passing it into the top of the lower pressure column through a throttling or pressure reduction valve.

Conventionally, the lower pressure column is operated at pressures in the range of 1 to 1.5 bar absolute. Liquid oxygen at the bottom of the lower pressure column is used to meet the condensation duty at the top of the higher pressure column. Accordingly nitrogen vapor from the top of the higher pressure column is heat exchanged with liquid nitrogen in the bottom of the lower pressure column. Sufficient liquid oxygen is able to be evaporated thereby to meet the requirements of the lower pressure column for reboil and to enable a good yield of gaseous oxygen product to be achieved. The pressure at the top of the higher pressure column and hence the pressure to which the incoming air is compressed are arranged to be such that the temperature of the condensing nitrogen is about one degree Kelvin higher than that of the boiling oxygen in the lower pressure column. In consequence of these relationships, it is not generally possible to operate the higher pressure column below a pressure of about 5.5 bar.

Improvements to the air separation process enabling the higher pressure column to be operated at a pressure below 5.5 bar have been proposed when the oxygen product is not of high purity, containing, say, from 2 to 20% by volume of impurities. U.S. Pat. No. 4,410,343 discloses that when such lower purity oxygen is required, rather than having the above-described link between the lower and higher pressure columns, air is employed to boil oxygen in the bottom of the lower pressure column in order both to provide reboil for that column and to evaporate the oxygen product. The resulting condensed air is then fed into both the higher pressure and the lower pressure column. A stream of oxygen-enriched liquid is withdrawn from the higher pressure column, is passed through a throttling valve and a part of it is used to perform the nitrogen condensing duty at the top of the higher pressure column.

U.S. Pat. No. 3,210,951 also discloses a process for producing impure oxygen in which air is employed to boil oxygen in the bottom of the lower pressure column in order both to provide reboil for that column and to evaporate the oxygen product. In this instance, however, oxygen-enriched liquid from an intermediate region of the lower pressure column is used to fulfil the duty of condensing nitrogen vapor produced in the higher pressure column.

Although the processes described in U.S. Pat. No. 4,410,343 and U.S. Pat. No. 3,210,951 make possible some measure of reduction in the ratio of the operating pressure of the higher pressure column to the operating pressure of the lower pressure column when the oxygen product is not pure, a further improvement would be particularly desirable. The present invention relates to methods and plants for separating impure oxygen from air which are intended to meet this need.

SUMMARY OF THE INVENTION

According to the present invention there is provided a method of separating air comprising rectifying a first stream of air in a higher pressure rectification column and thereby producing nitrogen vapor and oxygen-enriched liquid; condensing at least some of the nitrogen vapor and employing at least some of the resulting condensate as reflux in the higher pressure rectification column; rectifying a stream of oxygen-enriched fluid in a lower pressure rectification column; providing liquid nitrogen reflux for the lower pressure rectification column; withdrawing impure product oxygen from the lower pressure rectification column; reboiling a first liquid taken from a first mass exchange region of the lower pressure rectification column and passing a flow of reboiled first liquid upwardly through the lower pressure rectification column; reboiling a second liquid taken from at least one second mass exchange region of the lower pressure rectification column, and passing a flow of reboiled second liquid upwardly through the lower pressure rectification column, wherein said second liquid is reboiled by indirect heat exchange with the first air stream, the said nitrogen vapor is condensed by indirect heat exchange with a third liquid taken from at least one third mass exchange region of the lower pressure rectification column and the second liquid is richer in oxygen than the third liquid but less rich in oxygen than the first liquid.

The invention also provides apparatus for separating air comprising a higher pressure rectification column for separating a first stream of air into nitrogen vapor and oxygen-enriched liquid; a condenser for condensing at least some of the nitrogen vapor having an outlet for condensate in communication with an inlet to the higher pressure rectification column for liquid nitrogen reflux; a lower pressure rectification column for rectifying a stream of oxygen-enriched fluid having a first inlet for the stream of oxygen-enriched fluid, a second inlet for liquid nitrogen reflux, and an outlet for impure product oxygen; a first reboiler for reboiling a first liquid having an inlet for the first liquid in communication with a first mass exchange region of the lower pressure rectification column and an outlet for reboiled first liquid communicating with the lower pressure rectification column whereby a flow of reboiled first liquid upwardly through the lower pressure rectification column is able to be created; a second reboiler for reboiling a second liquid by indirect heat exchange with the first stream of air, said second reboiler having an inlet for the second liquid communicating with at least one second mass exchange region of the lower pressure rectification column and an inlet for the first stream of air and an outlet for reboiled second liquid communicating with the lower pressure rectification column, whereby a flow of reboiled second liquid is able to pass upwardly through the lower pressure rectification column; wherein said condenser has reboiling passages having an inlet for a third liquid communicating with at least one third mass exchange region of the lower pressure rectification column, and the communication between the said inlets for the first, second and third liquids and respectively the first, second and third mass exchange regions of the lower pressure rectification column is such that in operation the second liquid is richer in oxygen than the third liquid but less rich in oxygen than the first liquid.

By reboiling both first and second liquids, it is possible to keep down the work expended in compressing incoming air and hence keep down the ratio of the pressure at the bottom of the higher pressure rectification column to the pressure at the bottom of the lower pressure rectification column.

Typically, at least part of the first air stream is condensed by its indirect heat exchange with the said second liquid.

The oxygen-enriched liquid is preferably taken directly or indirectly from the higher pressure rectification column.

The higher pressure rectification column is preferably operated at a pressure at its bottom essentially the same as the pressure at or under which the first air stream passes out of indirect heat exchange with the said second liquid taken from the second mass exchange region of the lower pressure rectification column.

The first mass exchange region is preferably the bottom one in the lower pressure rectification column. Typically, the first liquid taken from the first mass exchange region of the lower pressure rectification column has the same composition as the impure oxygen product withdrawn therefrom.

In some examples of a method according to the invention the said first liquid is preferably reboiled by indirect heat exchange with a second air stream at a higher pressure than the first air stream, at least part of the second air stream thereby being condensed. The second air stream is preferably reduced in pressure downstream of its heat exchange with the first air stream and is introduced into the higher pressure rectification column. If desired, the second air stream may be enriched in oxygen upstream of its heat exchange with the said first liquid. This enrichment is preferably performed in a liquid-vapor contact column with oxygen-enriched liquid withdrawn from the lower pressure rectification column. A resulting oxygen-enriched second air stream is formed. Enriching the second air stream in oxygen reduces the pressure at which the second air stream needs to be provided in order to reboil the first liquid and makes it possible for the second air stream to be supplied at the same pressure as the first air stream. The said oxygen-enriched liquid is preferably raised to the pressure of the liquid-vapor contact column by means of a pump.

Preferably, the oxygen product is withdrawn in liquid state. By so doing, the proportion of the air to be separated which is employed as the second air stream may be kept down to about 15% or less by volume. Accordingly, the overall power consumption of the process is kept down. Alternatively, it is possible to take the third oxygen product as gas but at the cost of an increased requirement for reboil of the first liquid and hence, therefore, for the second air stream typically to form a greater proportion of the incoming air flow.

Preferably a third air stream is introduced into the lower pressure rectification column.

The respective air streams are preferably taken from one or more sources of compressed air that has been purified by removal of water vapor and carbon dioxide and cooled to a temperature suitable for its separation by rectification.

The method and apparatus according to the invention are suitable for use in processes in which the lower pressure rectification column operates at a conventional low pressure, that is at a pressure below 1.5 bar at its bottom and in processes in which the lower pressure rectification column is operated at substantially higher pressure, for example, in the range of 2.5 to 5 bar. In examples of low pressure processes, in which the impure oxygen is taken in liquid state, the impure oxygen product is preferably vaporized by indirect heat exchange with a stream of compressed air at a higher pressure than the pressure at the bottom of the higher pressure rectification column. The third air stream may be used for this purpose. In examples of higher pressure processes, impure liquid oxygen product may be vaporized by heat exchange with a condensing fluid that downstream of its heat exchange is employed as reflux in one or both of the rectification columns.

The said first and second reboilers in the said condenser may be located within the lower pressure rectification column. Alternatively, one or more may be located outside the lower pressure rectification column.

The rectification column may effect liquid-vapor contact by means of distillation trays or by packing, for example structured packing. In comparison with distillation trays, there are typically fewer mass exchange locations where liquid can be withdrawn for reboil and returned from reboil. If it is not possible to obtain from a single region of the lower pressure rectification column a second liquid for optimum composition for indirect heat exchange with the first air stream, a suitable composition of liquid may be achieved by withdrawing second liquid from two spaced apart mass exchange regions of the lower pressure rectification column at chosen rates and mixing them so as to give a desired composition of second liquid.

The method and apparatus according to the present invention are suitable for use in producing an impure oxygen product containing from 85 to 97% by volume of oxygen. If desired a purer oxygen product (say, containing about 0.5% by volume of impurities) may also be produced, but at a rate substantially less than that at which the impure oxygen product is produced. To this end, liquid-vapor contact surfaces are located within the lower pressure rectification column at levels intermediate that of the outlet for the impure oxygen product and that of an outlet for the purer oxygen product.

BRIEF DESCRIPTION OF THE DRAWINGS

The method and apparatus according to the present invention will now be described by way of example with reference to the accompanying drawings, in which each of FIGS. 1 to 7 is a schematic flow diagram, not to scale, of an air separation plant.

DETAILED DESCRIPTION

Figure 1:
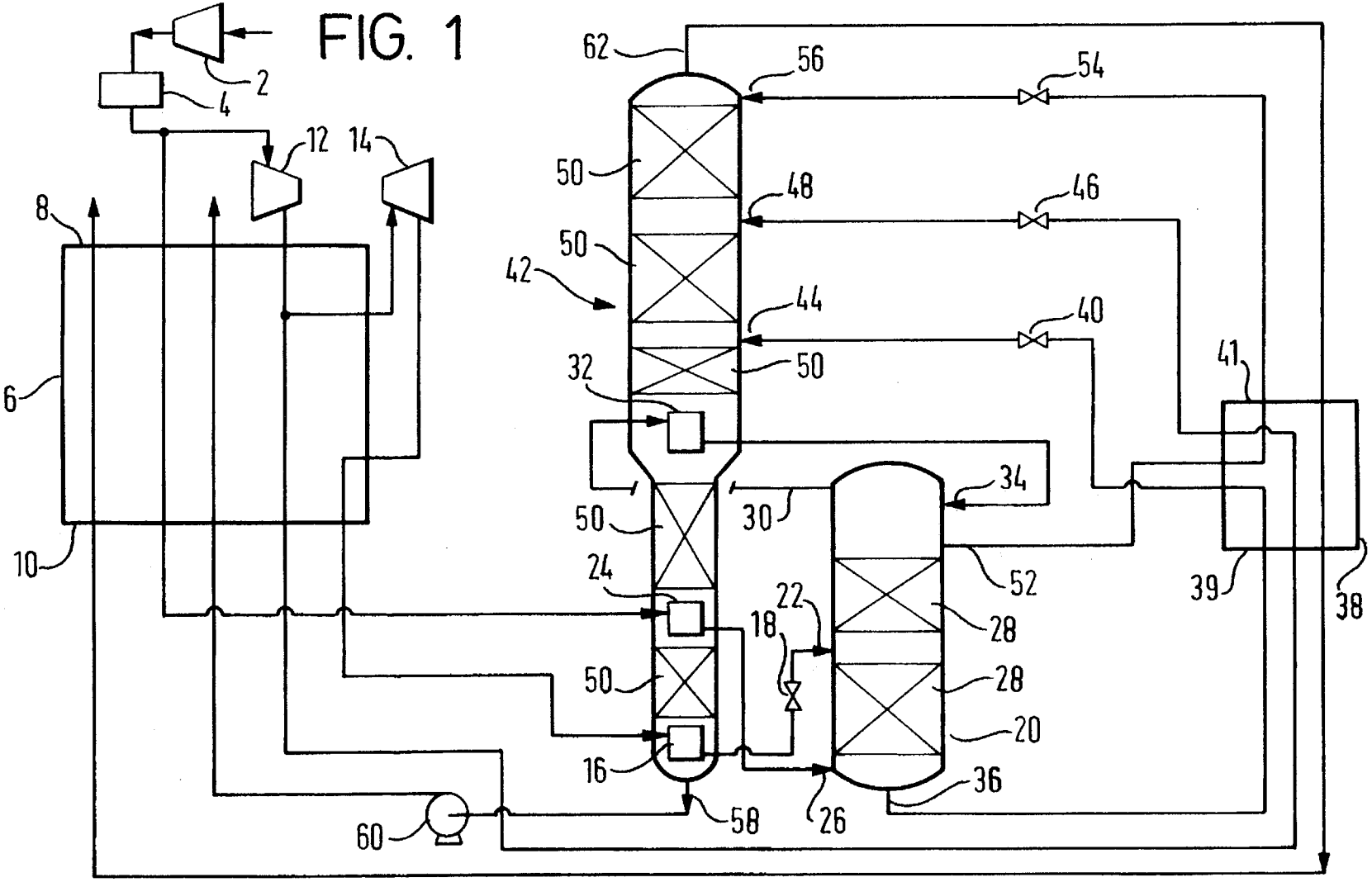
In FIGS. 1 to 4 and 6 and 7, like parts are identified by the same reference numerals in each FIG.

Referring to FIG. 1 of the drawings, air is compressed in a compressor 2 to a chosen pressure. The resulting flow of compressed air passes through a purification apparatus or unit 4 which removes water vapor and carbon dioxide from the air. The unit 4 employs beds of adsorbent (not shown) to effect this removal of water vapor and carbon dioxide. The beds are operated out of sequence with one another typically such that while one or more beds are being used to purify air, the remainder are being regenerated for example by means of a stream of hot nitrogen. Such purification apparatus and its operation are well known in the art and need not be described further.

The purified air flow is divided into major and minor streams. The major stream (typically about 55% of the total flow of purified air) flows through a main heat exchanger 6 from its warm end 8 to its cold end 10. The major air stream typically leaves the cold-end 10 of the main heat exchanger 6 as a vapor at or close to its saturation temperature and is therefore at a temperature suitable for its separation by rectification. The minor purified air stream is further compressed in a booster-compressor 12. The thus compressed minor air stream flows through the main heat exchanger 6 from its warm end 8 to its cold end 10 and is thereby cooled to a temperature sufficient to cause it to liquefy. A slip stream is withdrawn from the minor air stream at a first region of the main heat exchanger 6 intermediate its warm end 8 and its cold end 10. The slip stream is expanded with the performance of external work in an expansion turbine 14. The resulting expanded minor air stream is reintroduced into the main heat exchanger 6 at a second region intermediate the first region thereof and its cold end 10. The slip stream leaves the main heat exchanger 6 again at its cold end 10 at its saturation temperature or a temperature close thereto.

The major air stream, the slip stream of air and the minor air stream are taken from the cold end 10 of the main heat exchanger 6 as respectively first, second and third streams of air for separation. The second air stream is passed through condensing passages of a first reboiler 16 and is at least partially condensed by indirect heat exchange with boiling liquid as shall be described below. The resulting at least partially condensed second air stream leaves the first reboiler 16, flows through a throttling valve 18 and is introduced into a higher pressure rectification column 20 through an inlet 22. The first air stream is passed through condensing passages (not shown) of a second reboiler 24 and is at least partially condensed by indirect heat exchange with boiling liquid as shall be described below. The resulting at least partially condensed first air stream leaves the second reboiler 24 and is introduced into the higher pressure rectification column 20 through an inlet 26.

The higher pressure rectification column 20 contains liquid-vapor contact surfaces 28 whereby a descending liquid phase is brought into intimate contact with an ascending vapor phase such that mass transfer between the two phases takes place. The liquid-vapor contact surfaces 28 may for example be provided by distillation trays (preferably of the sieve kind) or by packing (preferably structured packing). In operation of the higher pressure rectification column 20, liquid collects at its bottom. This liquid is approximately in equilibrium with air vapor introduced into the column 20 through the inlet 26 and is thus somewhat enriched in oxygen. Nitrogen vapor is obtained at the top of the higher pressure rectification column 20.

A stream of the nitrogen vapor is withdrawn from the top of the higher pressure rectification column 20 through an outlet 30 and is condensed by as it passes through a condenser 32 by indirect heat exchange with boiling liquid as shall be described below. The resulting liquid nitrogen condensate is returned to the higher pressure rectification column 20 through an inlet 34 at its top. A part of the liquid nitrogen condensate is employed as reflux in the higher pressure rectification column 20, flowing down the column in mass exchange relationship with ascending vapor.

A stream of oxygen-enriched liquid air is withdrawn from the higher pressure rectification column 20 through an outlet 36, is sub-cooled by passage through a heat exchanger 38 from its warm end 39 to an intermediate region thereof. The sub-cooled oxygen-enriched air stream flows out of the heat exchange 38 from the intermediate region, is passed through a throttling valve 40 and is introduced into a lower pressure rectification column 42 through an inlet 44. The lower pressure rectification column 42 also receives the third air stream through an inlet 48 to the column 42 at a level above that of the inlet 44, this air stream having been taken from the cold end 10 of the main heat exchanger 6, passed through the heat exchanger 38 from its warm end 39 to the intermediate region from which the oxygen-enriched liquid stream is withdrawn, withdrawn from the heat exchanger at the intermediate region, and passed through a throttling valve 46 upstream of the inlet 48. The third air stream and oxygen-enriched liquid air stream are separated in the lower pressure rectification column 42 into nitrogen which is obtained at the top of the column 42 and impure oxygen (typically containing about 95% by volume of oxygen) at its bottom. In order to enable this separation to be performed in the lower pressure rectification column 42, the column 42 contains liquid-vapor contact surfaces 50 to enable descending liquid to be brought into intimate contact with ascending vapor such that mass exchange between the liquid and the vapor takes place. The liquid-vapor contact surfaces 50 may for example be provided by distillation trays (preferably of the sieve kind) or by packing (preferably structured packing).

A descending flow of liquid within the lower pressure rectification column 42 is created by taking from the higher pressure rectification column 20 through an outlet 52 another part of the liquid nitrogen condensate formed in the condenser 32, sub-cooling it by passage through the heat exchange 38, (the nitrogen stream entering the heat exchanger 38 at the intermediate region thereof from which the oxygen-enriched liquid is withdrawn, passing the sub-cooled liquid nitrogen stream through a throttling valve 54 and introducing it into the lower pressure rectification column 42 through an inlet 56 at a level above all the liquid-vapor contact surfaces 50 in the column 42.

A flow of ascending vapor is created in the lower pressure rectification column 42 by taking from liquid-vapor mass exchange regions therein first, second and third liquids of different composition from one another and reboiling these liquids. The first liquid, typically containing about 95% by volume of oxygen, is part of the impure liquid oxygen obtained at the bottom of the column 42. This impure liquid oxygen is taken from a bottom mass exchange region of the lower pressure rectification column 42. A part of it is withdrawn from the column 42 through an inlet 58 at its bottom. The remainder is reboiled in the first reboiler 16 by indirect heat exchange with the air stream, the second air stream thus being at least partially condensed as previously described. The reboiler 16 is typically at least partially immersed in a volume of impure liquid oxygen at the bottom of the column 42 and may therefore be of the thermosiphon kind. Resulting impure oxygen vapor passes out of the top of the reboiler 16 and ascends the lower pressure rectification column 42. The second liquid is typically taken from an intermediate mass exchange region of the lower pressure rectification column 42 where the oxygen concentration in the liquid phase is about 80% by volume. The second liquid is partially or totally reboiled by passage through the reboiler 24 which is located within the lower pressure rectification column 42. The downwardly flowing second liquid is reboiled in the reboiler 24 by heat exchange with the first air stream, the first air stream thereby being at least partially condensed as previously described. The resulting vaporized second liquid passes out of the reboiler 24 and ascends the lower pressure rectification column 42. The third liquid is typically taken from another intermediate mass exchange region of the lower pressure rectification column 42. The oxygen content in the liquid phase at this other intermediate mass exchange region of the lower pressure rectification column is preferably in the range of 40 to 50% by volume. The third liquid is partially or totally reboiled by downward passage through the reboiling passages of the condenser 32 which is located within the lower pressure rectification column 42. The downwardly flowing third liquid is reboiled in the condenser 32 by heat exchange with condensing nitrogen taken from the higher pressure rectification column 12 as previously described. The resulting vaporized third liquid passes out of the condenser 32 and ascends the lower pressure rectification column 42.

A stream of impure liquid oxygen product is withdrawn from the lower pressure rectification column 42 thorough the outlet 58 by operation of a pump 60. The pump 60 urges the impure liquid oxygen into the main heat exchanger 6 at its cold end 10. The impure oxygen stream flows through the main heat exchanger 10 from its cold end 10 to its warm end 8, being fully vaporized therein. Resultant impure gaseous oxygen product leaves the warm end 8 of the main heat exchanger 6 at approximately ambient temperature.

A stream of gaseous nitrogen product is withdrawn from the top of the lower pressure rectification column 42 through an outlet 62. The nitrogen product flows through the heat exchanger 38 from its cold end 41 to its warm end 39 thereby providing cooling for the heat exchanger 38. From the warm end 39 of the heat exchanger 38 the nitrogen product stream flows to the cold end 10 of the main heat exchanger 6, and from there through the main heat exchanger 6 to its warm end 8. The nitrogen product stream leaves the main heat exchanger 6 at approximately ambient temperature.

Numerous changes and modifications may be made to the plant shown in FIG. 1 and its operation. For example, any of the reboilers 16 and 24 and the condenser 32 may be located externally of the lower pressure rectification column 42 and may each take the form of a heat exchanger operating on the thermosiphon principle with the heat exchanger at least partially immersed in the liquid to be reboiled.

Other modifications to the plant shown in FIG. 1 are possible. For example, if the lower pressure rectification column is packed, there will be typically fewer levels of it from which liquid may be withdrawn for reboiling in an external reboiler. If there is not a convenient location from which a second liquid containing from 55 to 60% by volume of oxygen can be withdrawn, in a modification which is not shown in FIG. 1, the second liquid can be formed by appropriate mixing of two streams of liquid taken from different mass exchange levels of the lower pressure rectification column 42, one stream having a concentration of oxygen less than that desired for the second liquid, and the other stream having a concentration of oxygen greater than that desired. As a further example, both the second reboiler 24 and the condenser 32 can be located outside the lower pressure rectification column 42 and both the second and third liquids can be formed by mixing one liquid stream having an oxygen concentration greater than that of the second liquid with a second liquid stream having an oxygen concentration less than that of the third liquid, the relative proportions of the two liquid streams being selected so as to give desired compositions for reboil.

In another possible modification of the plant shown in FIG. 1, there is an additional stream of air which is taken from the first air stream at a region intermediate the cold end 10 of the main heat exchanger 6 and the second reboiler 24. The additional stream by-passes the second reboiler 24 and is introduced into the higher pressure rectification column 20 at a chosen level. Typically, if this additional stream of air is taken, all the first stream of air entering the reboiler 24 is totally condensed therein. It is similarly possible to take a part of the second air stream from intermediate the cold end 10 of the main heat exchanger 6 and the first reboiler 16, and to pass this part of the second air stream through a throttling or pressure reduction valve (not shown) and introduce it into the higher pressure rectification column 20 without passing through the first reboiler 16. In general, liquid air streams are introduced into the higher pressure rectification column 20 at a higher mass exchange level than vaporous air streams of the same composition. If desired, if an air stream to be introduced into the higher pressure rectification column 20 comprises both liquid and vapor phases it may be passed into a phase separator (not shown) in order to separate the liquid phase from the vapor stream upstream of the higher pressure rectification column 20.

Another modification that can be made to the plant shown in FIG. 1 is to employ a lower pressure rectification column 42 comprising two or more discrete vessels. For example, the second reboiler 24 may be located in the sump of an upper vessel (not shown) and liquid may flow therefrom under gravity into a lower vessel (not shown) which contains the first reboiler 16 and the liquid-vapor contact surfaces 50 intermediate the first reboiler 16 and the second reboiler 24. Vapor flows from the top of the lower vessel into a bottom region of the upper vessel.

Figure 2:
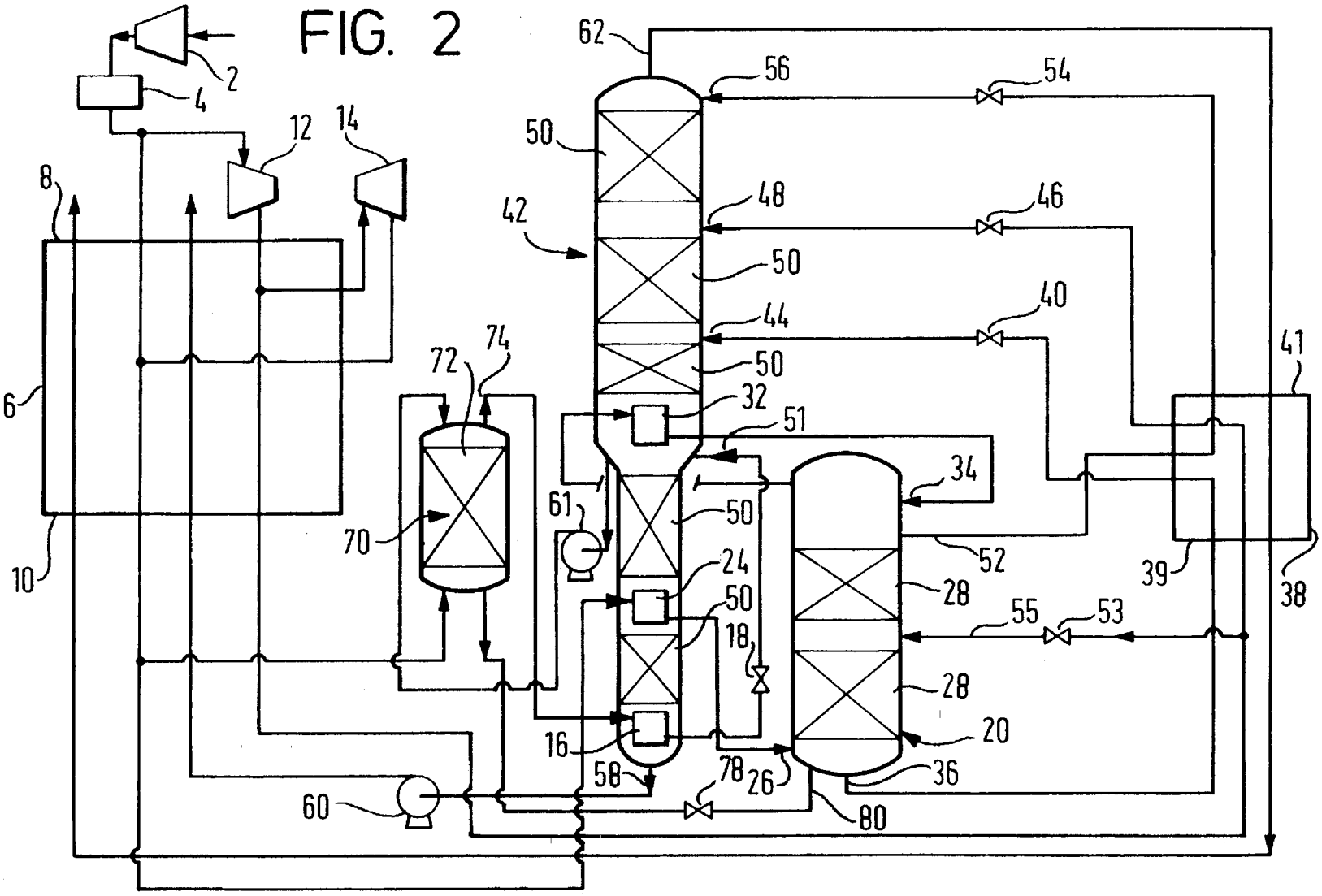

Yet another modification to the plant shown in FIG. 1 is illustrated in FIG. 2 of the accompanying drawings. In this modification, the second air stream is expanded in the turbine 14 to the pressure of the first air stream. The first and second air streams are merged in the heat exchanger 6 at a region intermediate its cold end 10 and the region from which the slip stream is taken for expansion in the turbine 14. The second air stream is in effect withdrawn again from the first air stream downstream of the cold end 10 of the heat exchanger 6 and is passed into the bottom of a liquid-vapor contact column 70 containing liquid-vapor contact surfaces 72 which may be provided by liquid-vapor contact trays or by packing, for example, structured packing. The second air stream as it ascends the column 70 undergoes mass exchange with a descending impure liquid oxygen stream. The impure liquid oxygen stream contains about 55% by volume of oxygen and is typically an intermediate mass exchange region of the lower pressure rectification column 42 by a pump 61 and pumped into the top of the column 70. The second air stream is enriched in oxygen as it ascends the column 70. An oxygen-enriched second air stream is withdrawn from the top of the column 70 through an outlet 74 and is passed through the first reboiler 16, thereby being at least partially condensed. The oxygen-enriched liquid air flows out of the reboiler 16 and through the throttling valve 18. The resulting stream is introduced into the lower pressure rectification column 50 through an inlet 51 (rather than being introduced into the higher pressure rectification column 20). Accordingly, in order to provide a liquid air feed to the higher pressure rectification column 20, a part of the third air stream is taken upstream of the heat exchanger 38, is passed through an expansion valve 53 and is introduced into the higher pressure rectification column 20 through an inlet 55. An oxygen-enriched liquid air stream passes out of the bottom of the column 70 through an outlet 76. The oxygen-enriched liquid air stream passes through a throttling valve 78 and flows into the higher pressure rectification column 20 through an inlet 80.

Enrichment of the second air stream in oxygen tends to raise its condensing temperature. Accordingly, in order to maintain an optimum condensing temperature on the first reboiler 16 it is necessary to reduce the pressure of the second air stream in comparison with its pressure in operation of the plant shown in FIG. 1. The outlet pressure of the expansion turbine 14 is thus lower and the outlet pressure of the booster-compressor 12 is also lower than in operation of the plant shown in FIG. 1. Thus, a power saving is made possible relative to the operation of the plant shown in FIG. 1.

Figure 3:
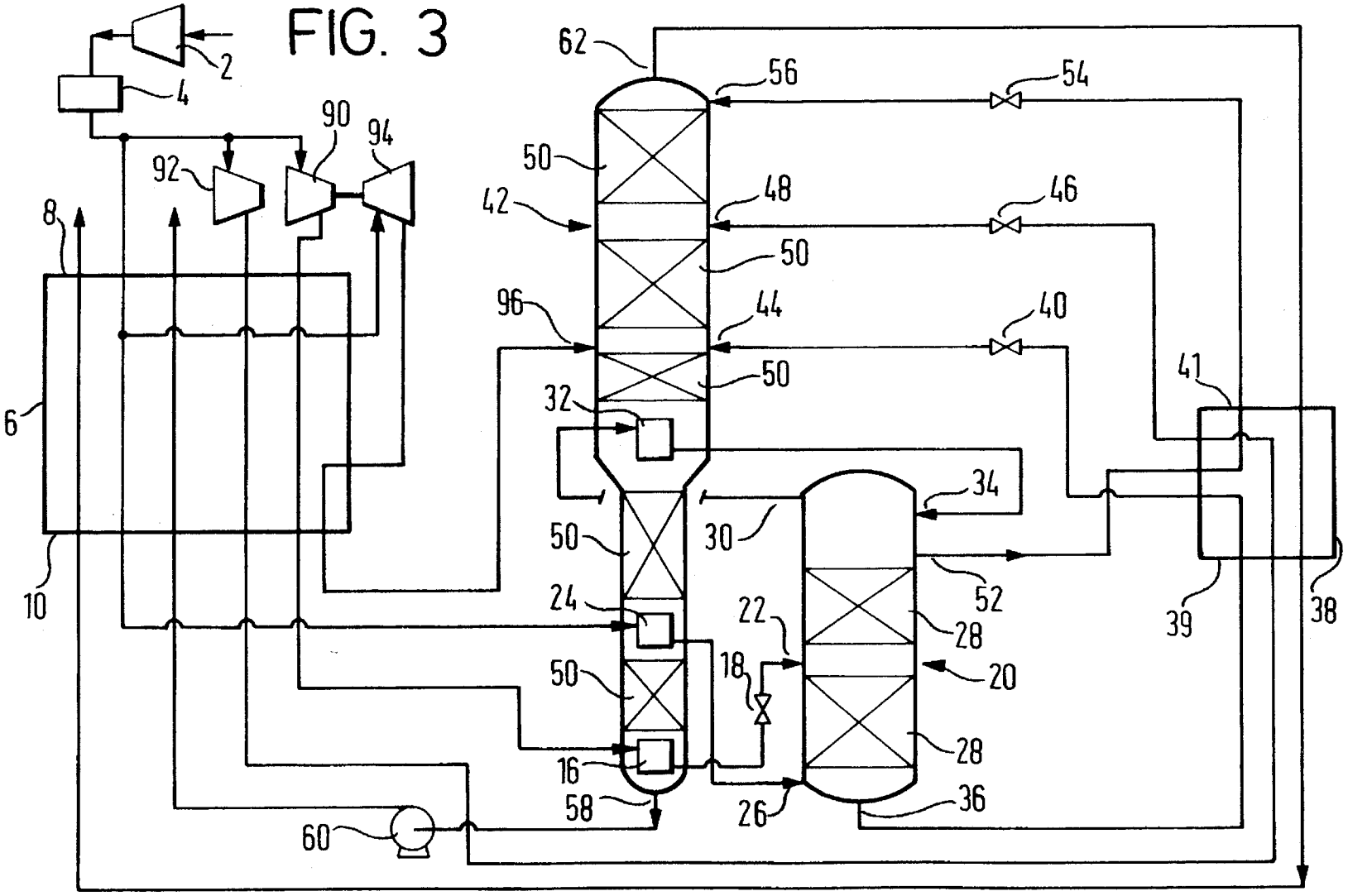

A yet further modification to the plant shown in FIG. 1 is illustrated in FIG. 3. In this modification, the minor air stream is divided upstream of the warm end 8 of the main heat exchanger 6 into two subsidiary streams. One subsidiary stream is compressed in a first booster-compressor 90. The resulting compressed air stream flows through the main heat exchanger 6 from its warm end 8 to its cold end 10. This air stream constitutes the second air stream that is at least partially condensed in the first reboiler 16. The other subsidiary air stream is compressed in a second booster-compressor 92. The compressed air stream leaves the outlet of the second booster-compressor 92 and flows through the main heat exchanger 6 from its warm end 8 to its cold end 10. This air stream is at least partially condensed by its passage through the main heat exchanger 6 and constitutes the third air stream that is introduced into the lower pressure rectification column. A fourth air stream is formed by withdrawing a slip stream of air from the major purified air stream at a region intermediate the warm end 8 and the cold end 10 of the man heat exchanger 6. The fourth air stream is expanded in an expansion turbine 94 with the performance of external work. The resulting expanded air stream is reintroduced into the main heat exchanger 6 at a second intermediate region thereof at a lower temperature than the first intermediate region. The fourth air stream flows through the main heat exchanger 6 from the second intermediate region to its cold end 10. The fourth air stream leaves the cold end 10 of the main heat exchanger 6 at approximately its saturation temperature and is introduced through an inlet 96 into the lower column 42 at a mass exchange region thereof above the condenser 32. The work performed by the expansion turbine 94 is the driving of the booster-compressor 90. In other respects, the plant shown in FIG. 3 is comparable to that shown in FIG. 1.

Figure 4:
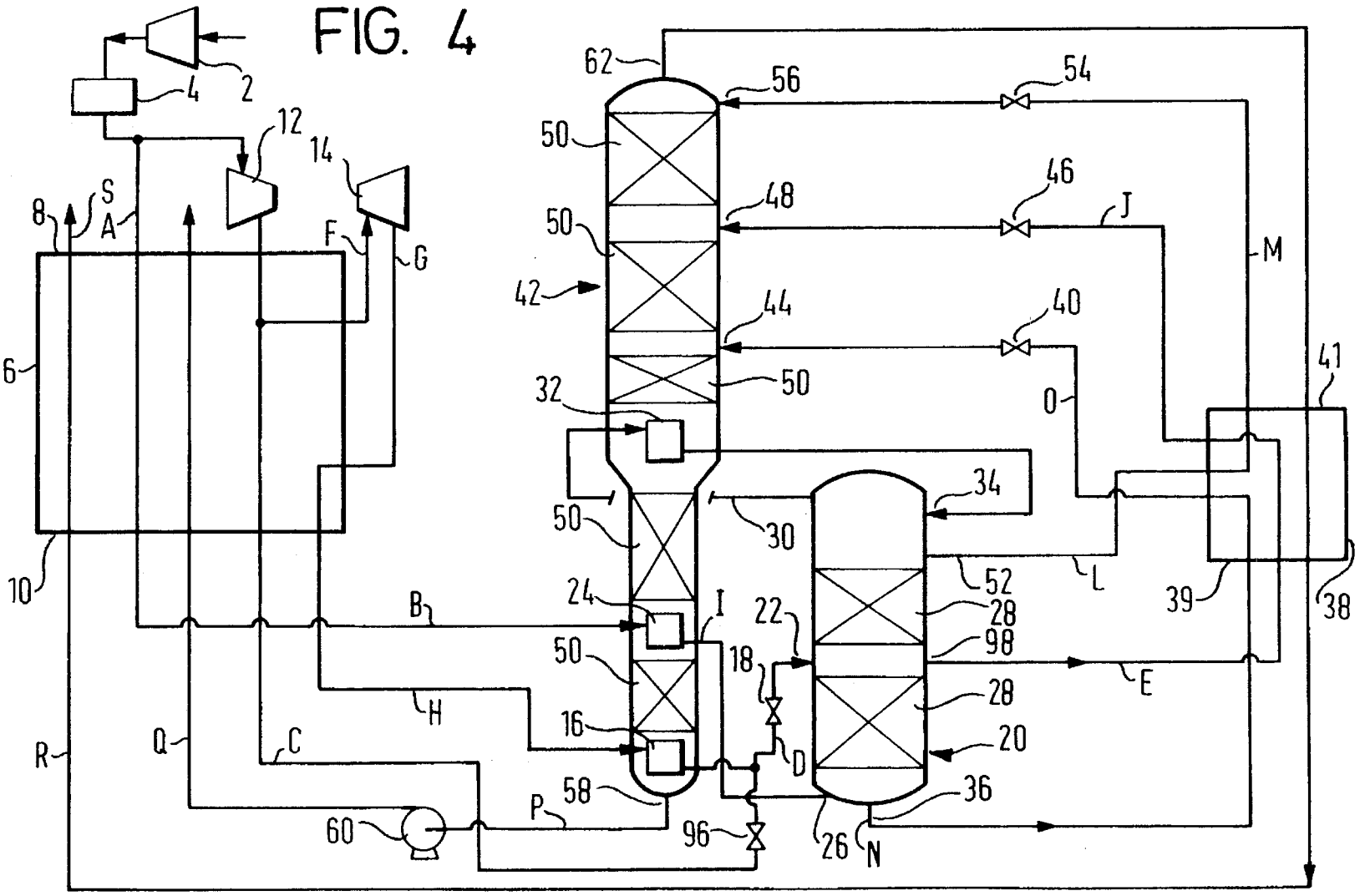

Another possible modification to the plant shown in FIG. 1 is illustrated in FIG. 4 of the accompanying drawings. In this modification, the entire third air stream passes through a throttling valve 96 downstream of the cold end 10 of the main heat exchanger 6. From the valve 96, the third stream of air passes into and mixes with the second stream of air intermediate the first reboiler 16 and the throttling valve 18. A stream of liquid air is withdrawn from the higher pressure rectification column 20 through an outlet 98 and forms the liquid air stream that is sub-cooled in the heat exchanger 38, is reduced in pressure by passage through the throttling valve 46, and is introduced into the lower pressure rectification column 20 from the inlet 48.

All the processes described above with reference to FIGS. 1 to 4 of the accompanying drawings are essentially low pressure processes, by which it is meant that the lower pressure rectification column 42 operates at its bottom at a pressure less than about 1.5 bar. In general, when the lower pressure rectification column 42 is operated thus, the operating pressure of the higher pressure rectification column 20 at its bottom can be kept to below 3.0 bar, and hence the outlet pressure of the compressor 2 can be kept to below 3.3 bar allowing for downstream pressure drops amounting to 0.3 bar. In an example of the operation of the plant shown in FIG. 2, the compressor 2 may have an outlet pressure of 2.8 bar and the expansion turbine 14 and outlet pressure of about 4 bar. The compressor 12 typically has an outlet pressure of 10 bar and the oxygen pump 60 raises the pressure of the impure oxygen product stream to 4 bar, although a wide variety of pressures are possible provided that the outlet pressure of the compressor 12 is always such that the liquefaction temperature of the third air stream is above the boiling temperature of the impure liquid oxygen product stream.

One reason for the relatively low operating pressures of processes according to the invention is that the second reboiler 24 is given a reboiling duty substantially in excess of that of the first reboiler 16. Since the condensing passages of the second reboiler 24 operate at a lower temperature than the condensing passages of the reboiler 16, the first stream of air is supplied at a lower pressure than the second stream of air. The process according to the invention represents a considerable advance on conventional so-called 'dual reboiler' processes in which the only reboil below the level of a nitrogen condenser corresponding to the condenser 32 is provided by a single reboiler at the bottom of the lower pressure rectification column. Efficient operation of processes according to the invention is also facilitated by condensation of the third stream of air by heat exchange with the liquid impure oxygen product. Typically, the impure oxygen product is pressurized by the pump 60 to a pressure of 3 to 8 and the third air stream leaves the cold end 10 of the main heat exchanger 6 at a pressure in the range of 5 to 20 so as to maintain a good match between the temperature enthalpy profile of the vaporizing impure liquid oxygen product stream and the condensing third air stream. The third air stream boosts the reflux at an intermediate level of the lower pressure rectification column 42.

It is not essential to the method and apparatus according to the present invention that the lower pressure rectification column be operated at a low pressure. Indeed, the method and apparatus according to the invention can be employed with advantage when it is desired to produce an elevated pressure nitrogen product from the lower pressure rectification column. Raising the operating pressure of the lower pressure rectification column has the effect of reducing the relative volatilities of the oxygen and nitrogen components separated therein. Accordingly, there tends to be a greater demand for liquid nitrogen reflux with increasing lower pressure rectification column operating pressure. In the plant illustrated in FIG. 5 of the accompanying drawings, the need for increased liquid nitrogen reflux in the lower pressure rectification column is moderated by flashing a preferably sub-cooled oxygen-enriched liquid air stream through a throttling valve so as to reduce its pressure to a valve intermediate the pressure at the bottom of the higher pressure rectification column and the pressure at the bottom of the lower pressure rectification column, partially reboiling the resulting stream, and separating resultant liquid and vapor phases in a phase separator. As a result, the liquid phase is further enriched in oxygen. A stream of the liquid phase is withdrawn from the phase separator and is introduced into the lower pressure rectification column. The vapor phase which is enriched in nitrogen is taken from the phase separator, is preferably condensed and is also introduced into the lower pressure rectification column.

Figure 5:
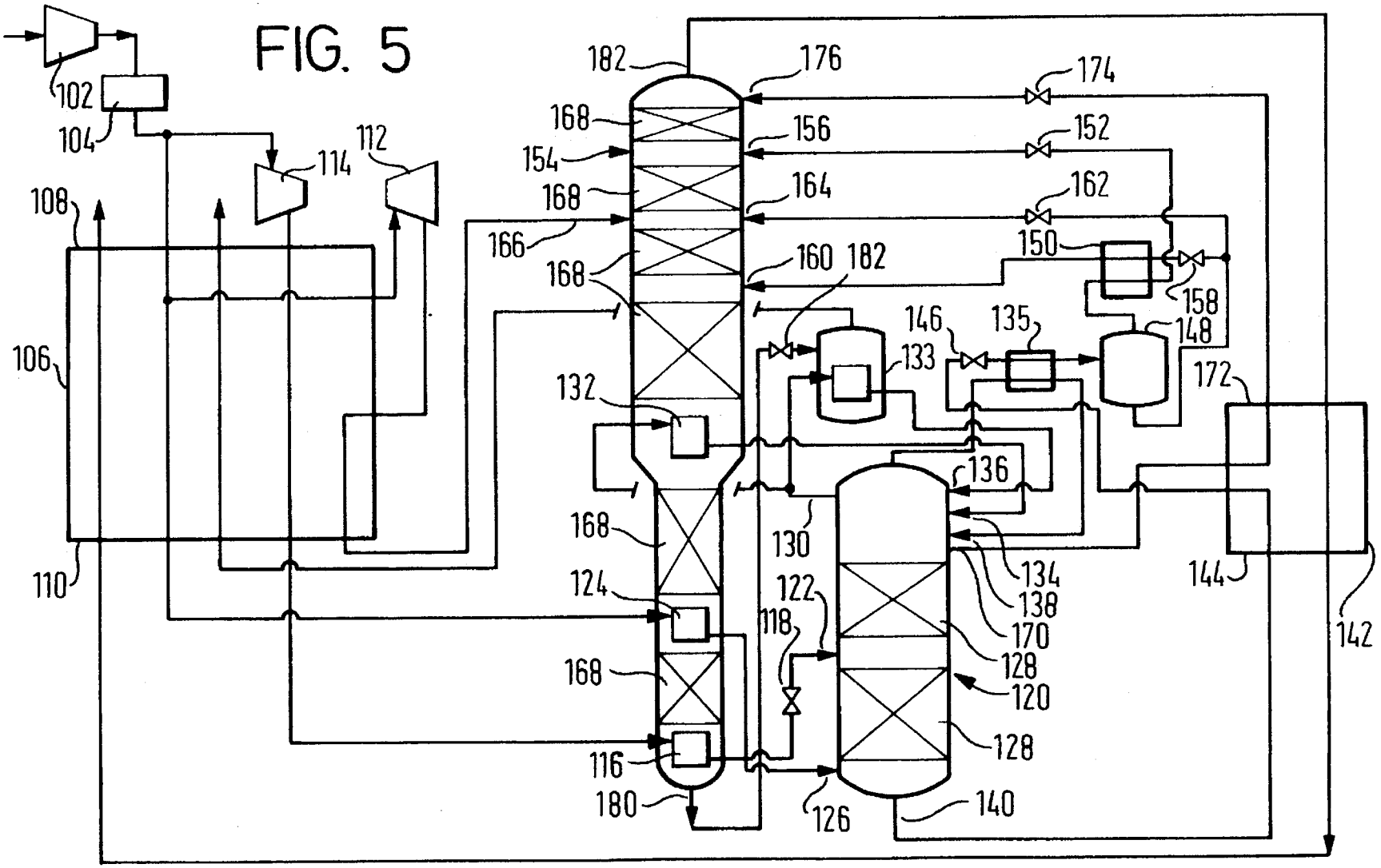

Referring to FIG. 5, a compressor 102 and a purification unit 104 are operated to produce a stream of compressed air essentially free of water vapor and carbon dioxide in a manner analogous to the compressor 2 and the purification unit 4 of the plant shown in FIG. 1. The compressed and purified air stream is divided into major and minor streams. Typically, at least 85% of the air enters the major stream. The major stream flows through a main heat exchanger 106 from its warm end 108 to its cold end 110. A slip stream is taken from the major air stream at a first intermediate region of the main heat exchanger 106 and is expanded with the performance of external work in an expansion turbine 112. The resulting expanded slip stream flows out of the expansion turbine 112 and re-enters the main heat exchanger 106 at a second intermediate region thereof which is at a lower temperature than the first intermediate region. The expanded slip stream flows from the second intermediate region through the main heat exchanger 106 to its cold end 110.

The compressed and purified air stream is further compressed in a booster-compressor 114. The resulting further compressed minor air stream flows through the main heat exchanger 106 from its warm end 108 to its cold end 110.

The major air stream exiting the heat exchanger 106 at its cold end 110 forms a first air stream for separation; the minor air stream exiting the main heat exchanger 106 at its cold end 110 forms a second air stream for separation and the expanded slip stream exiting the main heat exchanger 106 at its cold end 110 forms a third air stream for separation.

The second air stream is passed through condensing passages of a first reboiler 116 and is at least partially condensed by indirect heat exchange with boiling liquid as shall be described below. The resulting at least partially condensed second air stream leaves the first reboiler 116, flows through a throttling valve 118 and is introduced into a higher pressure rectification column 120 through an inlet 122. The first air stream is passed through condensing passages of a second reboiler 124 and is at least partially condensed by indirect heat exchange with boiling liquid as shall be described below. The resulting at least partially condensed first air stream leaves the second reboiler 124 and is introduced into a higher pressure rectification column 120 through an inlet 126.

The higher pressure rectification column 120 contains liquid-vapor contact surfaces 128 whereby a descending liquid phase is brought into intimate contact with an ascending vapor phase such that mass transfer between the two phases takes place. Liquid collects at the bottom of the higher pressure rectification column 120. This liquid is approximately in equilibrium with air vapor introduced into column 120 through the inlet 126 and is thus somewhat enriched in oxygen. Nitrogen vapor is obtained at the top of a higher pressure rectification column 120. A first stream of nitrogen vapor withdrawn from the top of the higher pressure rectification column 120 through an outlet 130 is condensed by indirect heat exchange with boiling liquid in a first condenser 132 as shall be described below. A second stream of nitrogen vapor withdrawn through the outlet 130 of the higher pressure rectification column 120 is similarly condensed in a second condenser 133 as will also be described below. A third nitrogen stream from the top of the higher pressure rectification column 120 is condensed in a third condenser 135 as will be described below. Resulting liquid nitrogen condensate from the first, second and third condensers is returned to the higher pressure rectification column 120 through inlets 134, 136 and 138 respectively at its top. A part of the liquid nitrogen condensate is employed as reflux in the higher pressure rectification column 120, flowing down the column in mass exchange relationship with ascending vapor.

A stream of oxygen-enriched liquid air is withdrawn from the higher pressure rectification column through an outlet 140, is sub-cooled by passage through a heat exchanger 142 from its warm end 144 to an intermediate region thereof, is withdrawn from this intermediate region and is flashed through a throttling valve 146. The resulting oxygen-enriched liquid air stream is partially reboiled as it passes through the third condenser 135 by indirect heat exchange with the third of the aforementioned streams of nitrogen taken from the top of the higher pressure rectification column 120. As a result of the partial reboiling, there is formed a liquid phase which has a greater concentration of oxygen than the original oxygen-enriched liquid air and a vapor phase which has a smaller proportion of oxygen than the original oxygen-enriched liquid air. The two phases are separated in a phase separator 148. A vapor stream is withdrawn from the top of the phase separator 148 and is condensed by passage through a fourth condenser 150. The resulting stream of condensate is passed through a throttling valve 152 and introduced into a lower pressure rectification column 154 at an upper mass exchange level thereof through an inlet 156. A liquid stream is withdrawn from the bottom of the phase separator 148 and is divided into two sub-streams. One sub-stream is passed through a throttling valve 158 and is reboiled by passage through the fourth condenser 150, the necessary cooling for the condensation of nitrogen vapor in the fourth condenser 150 thereby being provided. The resultant reboiled sub-stream is introduced into the lower pressure rectification column 154 through an inlet 160. The other sub-stream of liquid withdrawn from the phase separator 148 is passed through a throttling valve 162 and is introduced into the lower pressure rectification column 154 through an inlet 164. In addition to the fluids introduced into the lower pressure rectification column 154 through the inlets 156, 160 and 164, the third air stream is introduced into the lower pressure rectification column 154 through an inlet 166 at the same level as the inlet 164.

The fluids introduced into the lower pressure rectification column 154 through the inlets 156, 160, 164 and 166 are separated therein into nitrogen which is obtained at the top of the column 154 and impure oxygen (typically containing about 95% by volume of oxygen) at its bottom. In order to enable this separation to be performed in the lower pressure rectification column 154, liquid-vapor contact surfaces 168 are provided therein to enable descending liquid to be brought into intimate contact with ascending vapor such that mass exchange between a liquid and the vapor takes place.

A descending flow of liquid within the lower pressure rectification column 154 is created by taking from the higher pressure rectification column 120 through an outlet 170 another part of the liquid nitrogen condensate formed in the condensers 132, 133 and 135. The liquid nitrogen stream withdrawn through the outlet 170 is sub-cooled by passage through the heat exchanger 142 (the nitrogen stream entering the heat exchanger 142 at the intermediate region thereof from which the oxygen-enriched liquid air stream is withdrawn for passage through the valve 146, and leaving the heat exchanger 142 at its cold end 172), passing the sub-cooled liquid nitrogen stream through a throttling valve 174 and introducing it into the lower pressure rectification column 154 through an inlet 176 at a level above all the liquid-vapor contact surfaces 168 therein.

A flow of ascending vapor is created for the lower pressure rectification column 154 by taking from liquid-vapor mass exchange regions therein first, second and third liquids of different composition from one another and reboiling these liquids. The first liquid, typically containing about 95% by volume of oxygen, is part of the impure oxygen obtained at the bottom of the column 154. It is reboiled in the first reboiler 116 by indirect heat exchange with the second air stream, thereby providing the necessary cooling at least partially to condense the second air stream. The reboiler 116 is typically at least partially immersed in a volume of impure liquid oxygen at the bottom of the column 154 and is typically of the thermosiphon kind. Resulting impure oxygen vapor passes out of the top of the first reboiler 116 and ascends the lower pressure rectification column 154.

The second liquid to be reboiled is typically taken from an intermediate mass exchange region of the lower pressure rectification column 154 where the oxygen concentration in the liquid phase is about 80% by volume. The second liquid is partially or totally reboiled by passage through the second reboiler 124 which is located within the lower pressure rectification column 154. The second liquid is reboiled in the reboiler 124 by heat exchange with the first air stream, the first air stream thereby being at least partially condensed as previously described. The resulting vaporized second liquid passes out of the reboiler 124 and ascends the lower pressure rectification column 154.

The third liquid is typically taken from another intermediate mass exchange region of the lower pressure rectification column 154. The oxygen content in the liquid phase at this other intermediate mass exchange region is preferably in the range of 40 to 50% by volume. The third liquid is partially or totally reboiled by downward passage through the reboiling passages of the first condenser 132 which is located within the lower pressure rectification column 154. The reboil of the downwardly flowing third liquid is by heat exchange with condensing nitrogen taken from the higher pressure rectification column 120 as previously described. The resulting vaporized third liquid passes out of the first condenser 132 and ascends the lower pressure rectification column 154.

A stream of impure liquid oxygen product, typically containing 95% by volume of oxygen, is withdrawn from the lower pressure rectification column 154 through an outlet 180 and flows through a pressure reducing or throttling valve 182 into the second condenser 133. The oxygen is vaporized in the second condenser 133 by indirect heat exchange with nitrogen taken as previously described from the top of the higher pressure rectification column 120. Resulting impure oxygen vapor flows from the second condenser 133 through the heat exchanger 106 from its cold end 110 to its warm end 108. The impure oxygen product exits the warm end 108 of the heat exchanger 106 at approximately ambient temperature.

A stream of gaseous nitrogen product is withdrawn from the top of the lower pressure rectification column 154 through an outlet 182. The nitrogen product flows through the heat exchanger 142 from its cold end 172 to its warm end 144 thereby providing cooling for this heat exchanger. The nitrogen product stream flows from the warm end 144 of the heat exchanger 142 through the main heat exchanger 106 from its cold end 110 to its warm end 108, leaving at approximately ambient temperature.

In a typical example of the operation of the plant shown in FIG. 5 of the drawings, the higher pressure rectification column 120 is operated at its bottom at a pressure of approximately 9.5 bar and the lower pressure rectification column 154 at a pressure at its bottom of approximately 4.5 bar. The condensing passages of the first reboiler 116 typically operate at a pressure in the order of 12 bar. An impure oxygen product (typically containing 95% by volume of oxygen) is produced at a pressure of 2.5 bar.

Figure 6:
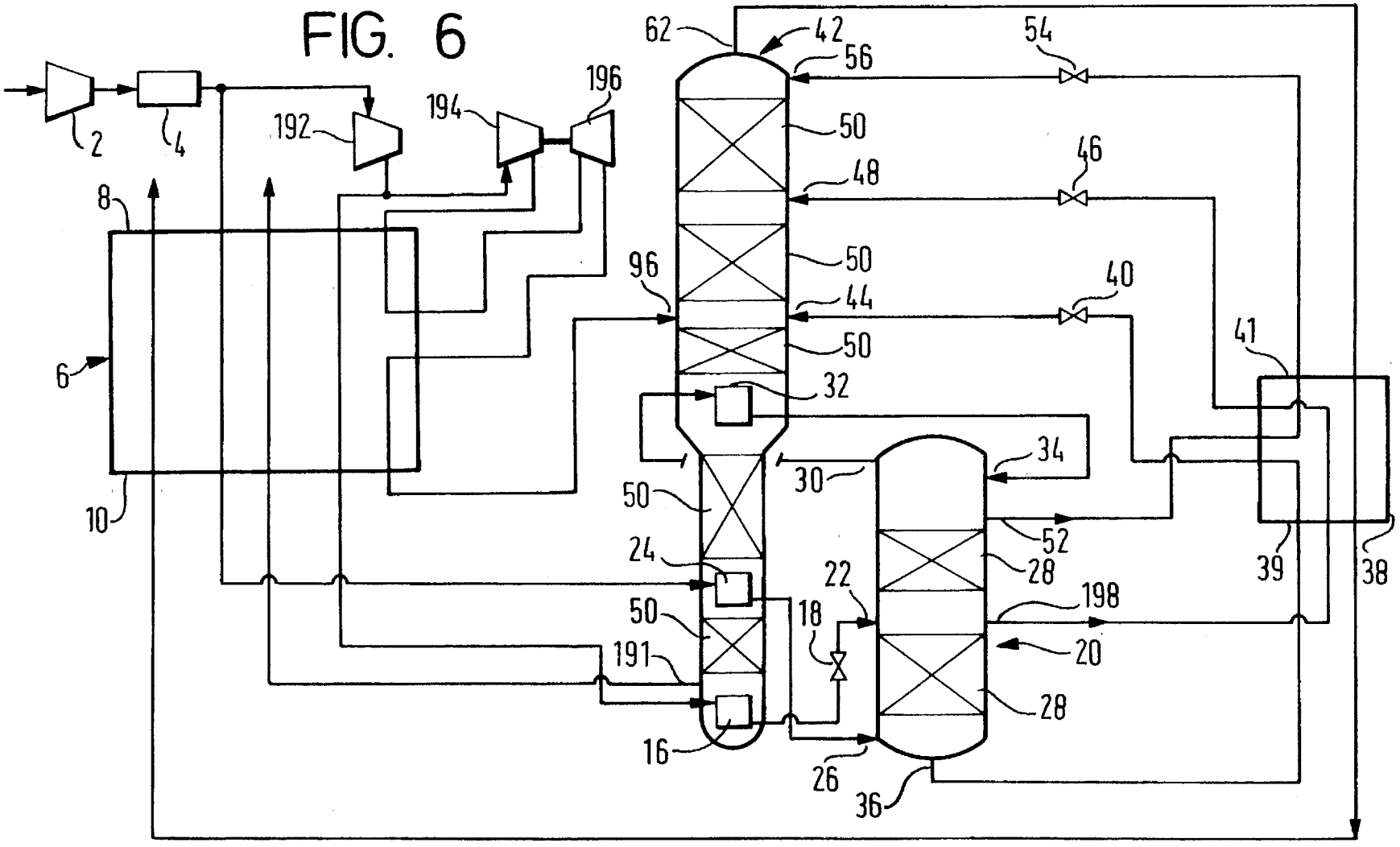

Referring now to FIG. 6, there is shown a plant generally similar to that shown in FIG. 3 with the exception that the impure oxygen product flows from the lower pressure rectification column 42 in vapor state. In consequence, there are a number of individual differences between the two plants as shall now be described. Firstly, in the plant shown in FIG. 6, there is no outlet 58 at the bottom of the lower pressure rectification column 42 for impure liquid oxygen product and no pump 60. Instead, impure gaseous oxygen product is withdrawn through outlet 191 from above the first reboiler and is warmed to ambient temperature by passage through the main heat exchanger 6 from its cold end 10 to its warm end 8. Secondly, since a high pressure air stream is no longer required for the purposes of vaporizing a liquid impure oxygen stream, there is a different arrangement of compressors and expander. All the minor stream of air flows to a booster-compressor 192 in which it is further compressed to about 4.5 bar. The resulting further compressed minor stream of air is divided into two subsidiary flows. One subsidiary flow constitutes the second air stream which passes through the main heat exchanger 6 from its warm end 8 to its cold end 10 and is employed in the reboiler 16 in the manner described with reference to FIG. 3. The other subsidiary air flow is compressed yet further in another booster-compressor 194. Downstream of the booster-compressor 194, the compressed air enters the main heat exchanger 6 through its warm end 8, is cooled to a first intermediate temperature therein, is withdrawn from the main heat exchanger at a first intermediate location corresponding to the first intermediate temperature, and is expanded in an expansion turbine 196 to approximately the pressure of the rectification column 42 with the performance of external work, for example the driving of the booster-compressor 194. The air leaving the turbine 196 is returned to a second intermediate location of the heat exchanger 6 and passes from that location to the cold end 10 of the heat exchanger 6, and downstream of the cold end 10 is introduced into the rectification column 42 through the inlet 96 as a stream equivalent to the fourth air stream described with reference to FIG. 3.

A third difference between the plant shown in FIG. 6 and that shown in FIG. 3 is that there is no third air stream in the former that runs from the compressor 192 through the heat exchanger 6 to the inlet 48 of the lower pressure rectification column 42. Instead, a liquid air stream flows from the higher pressure rectification column 20 of the plant shown in FIG. 6 through an outlet 198, is sub-cooled in the heat exchanger 38, and is passed through the throttling valve 46 to provide a liquid air stream that is introduced into the lower pressure rectification column 42 through the inlet 48.

In operation, a significantly greater flow rate of the second air stream is employed in the plant shown in FIG. 6 in comparison to that employed in the plant shown in FIG. 3. This greater flow rate of the second air stream provides more heating for the reboiler 16 and thereby enables impure oxygen product to be taken from the lower pressure column 42 in the gaseous state at an adequate rate.

Figure 7:
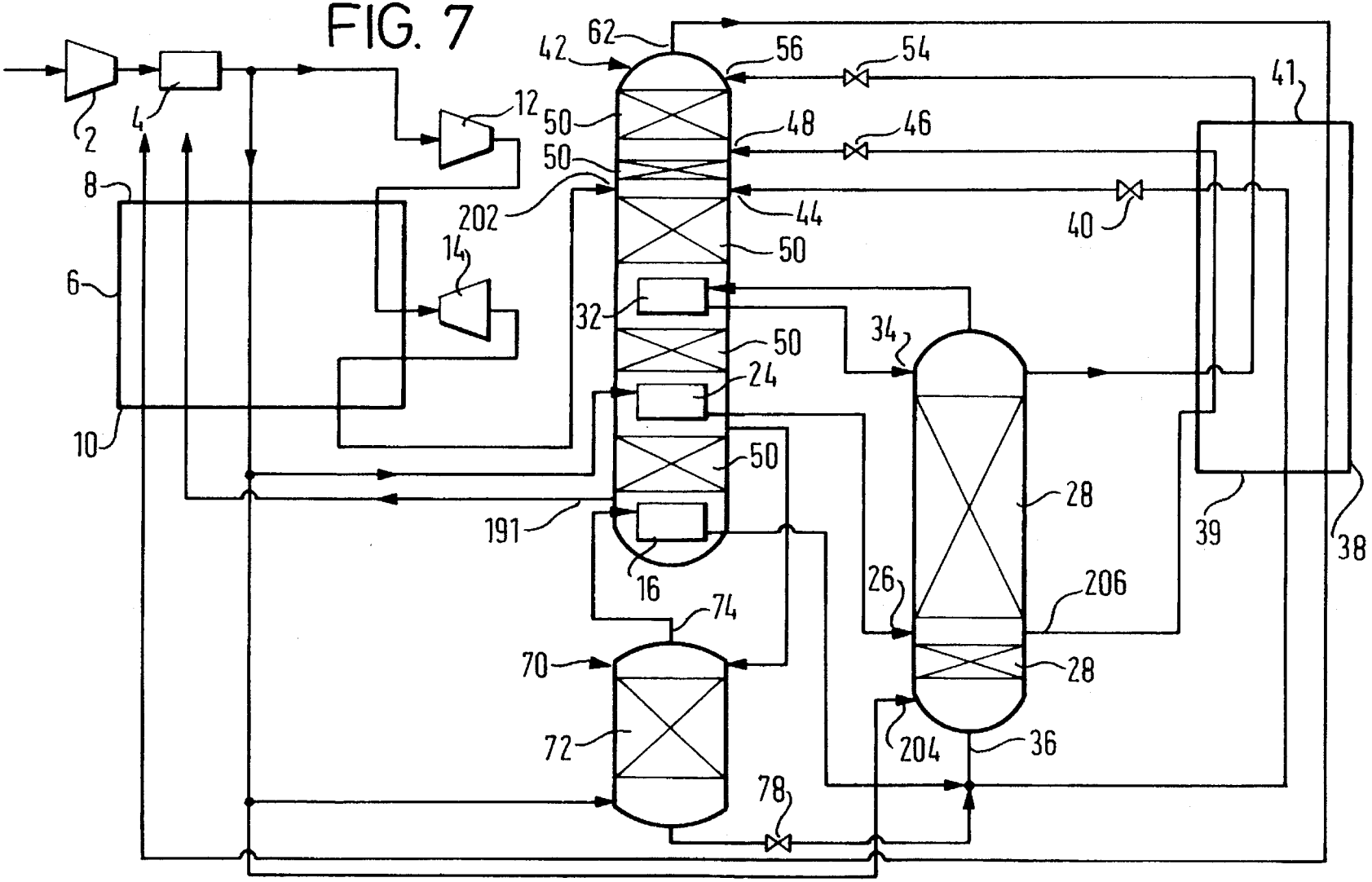

Referring now to FIG. 7, there is shown a plant generally similar to that shown in FIG. 2. However, in the plant shown in FIG. 7 the impure oxygen product is taken from the rectification column 42 in gaseous state through outlet 191 and in consequence the plant shown in FIG. 7 differs from that shown in FIG. 2 in a number of ways. In addition, there are a number of other minor differences between the two plants.

Since in the plant shown in FIG. 7 the oxygen product is withdrawn in gaseous state there is no outlet 58 at the bottom of the rectification column 42 and no pump 60 and associated wall pipework included therein. Further, since there is not a requirement in the plant shown in FIG. 7 to vaporize a liquid oxygen product stream in the heat exchanger 6, all the air from the compressor 12 flows to the expansion turbine 14. Rather than reuniting the expanded air stream produced in the turbine 14 with the purified air stream flowing through the main heat exchanger at essentially the pressure at which the air leaves the purification unit 4, the expanded air is further reduced in temperature by passage through the main heat exchanger 6 from a chosen intermediate region thereof to its cold end 10, and downstream of the cold end 10 is introduced into the lower pressure rectification column 42 through an inlet 202 at the same level as the inlet 44.

The first and second air streams are formed in an analogous manner to that shown in and described above with reference to FIG. 2. However, the liquid stream taken from the bottom of the mixing column 70 rather than being introduced into the higher pressure rectification column 20, in the manner shown in FIG. 2, is mixed with the liquid stream withdrawn from the column 20 through the outlet 36. In addition, no pump 61 is used to feed liquid to the top of the mixing column 70. Instead, a gravity feed is relied upon. The arrangement of feeds to the higher pressure rectification column 20 is different from that shown in FIG. 2. In the plant shown in FIG. 7, a part of the cold air stream that leaves the cold end 10 of the main heat exchanger 6 at essentially the pressure at which the air exits the purification unit 4 is introduced into the bottom of the higher pressure rectification column 20 through an inlet 204. Further, the inlet 26 is located above some of the liquid-vapor contact devices 28 in the column 20. Since all the air from the compressor 12 flows to the expansion turbine 14, there is no flow from the compressor 12 to either the higher pressure rectification column 20 or the lower pressure rectification column 42. In order to provide a liquid air stream that is introduced into the lower pressure rectification column 20 through the inlet 48, a liquid air stream is withdrawn from the higher pressure column 20 through an outlet 206, is sub-cooled in the heat exchanger 38 and is passed through the throttling valve 46 to form a stream that is introduced through the inlet 48. A final difference between the plant shown in FIG. 7 and that shown in FIG. 2 is that in the former air stream that exits the reboiler 16 is united with the liquid withdrawn from the higher pressure rectification column 20 through the outlet 36 and the liquid stream withdrawn from the bottom of the mixing column 70.

In operation, a significantly greater flow rate of the second air stream employed in the plant shown in FIG. 7 in comparison to that employed in the plant shown in FIG. 2. This greater flow rate provides more heating for the reboiler 16 and thereby enables impure oxygen product to be taken from the lower pressure rectification column 42 at an adequate rate in the vapor state.

An example of the process illustrated in FIG. 4 is given below in Table 1 in which are set out the flow rate, temperature, pressure, composition, and state of each of the process streams identified in FIG. 4 by the letters A to S.

| Stream | flow rate/ $sm^3\ hr^{-1}$ | pressure/ bar | temperature/ K. | composition mole fraction $O_2$ | Ar | $N_2$ | state* |
|---|---|---|---|---|---|---|---|
| A | 172103.8 | 2.68 | 281.0 | 0.21 | 0.01 | 0.78 | 100% V |
| B | 172103.8 | 2.43 | 93.0 | 0.21 | 0.01 | 0.78 | 100% V |
| C | 92677.1 | 9.09 | 93.0 | 0.21 | 0.01 | 0.78 | 100% L |
| D | 50360.0 | 4.16 | 93.7 | 0.21 | 0.01 | 0.78 | 100% L |
| E | 70000.0 | 2.42 | 87.4 | 0.22 | 0.01 | 0.77 | 100% L |
| F | 50360.0 | 8.94 | 144.3 | 0.21 | 0.01 | 0.78 | 100% V |
| G | 50360.0 | 8.94 | 120.0 | 0.21 | 0.01 | 0.78 | 100% V |
| H | 50360.0 | 4.18 | 96.2 | 0.21 | 0.01 | 0.78 | 100% V |
| I | 172103.8 | 2.40 | 88.7 | 0.21 | 0.01 | 0.78 | 68% V |
| J | 70000.0 | 2.37 | 84.0 | 0.22 | 0.01 | 0.77 | 100% L |
| L | 82570.9 | 2.40 | 85.5 | 0.01 | — | 0.99 | 100% L |
| M | 82570.9 | 2.35 | 81.0 | 0.01 | — | 0.99 | 100% L |
| N | 162570.0 | 2.43 | 88.4 | 0.31 | 0.01 | 0.68 | 100% L |
| O | 162570.0 | 2.38 | 86.5 | 0.31 | 0.01 | 0.68 | 100% L |
| P | 68189.9 | 1.35 | 92.4 | 0.95 | 0.04 | 0.01 | 100% L |
| Q | 68189.9 | 3.45 | 92.5 | 0.95 | 0.04 | 0.01 | 100% V |
| R | 246951.1 | 1.27 | 86.3 | 0.01 | — | 0.99 | 100% V |
| S | 246951.1 | 1.14 | 278.0 | 0.01 | — | 0.99 | 100% V |

*Percentages are by volume
L = Liquid
V = Vapor

I claim:

1. A method of separating air comprising:

rectifying a first stream of air in a higher pressure rectification column and thereby producing nitrogen vapor and oxygen-enriched liquid;

condensing at least some of the nitrogen vapor and employing at least some of the resulting condensate as reflux in the higher pressure rectification column;

rectifying a stream of oxygen-enriched fluid in a lower pressure rectification column;

providing liquid nitrogen reflux for the lower pressure rectification column;

withdrawing impure product oxygen from the lower pressure rectification column;

reboiling a first liquid taken from a first mass exchange region of the lower pressure rectification column and passing a flow of reboiled first liquid upwardly through the lower pressure rectification column;

reboiling a second liquid taken from at least one second mass exchange region of the lower pressure rectification column, and passing a flow of reboiled second liquid upwardly through the lower pressure rectification column;

said second liquid being reboiled by indirect heat exchange with the first air stream;

the said nitrogen vapor being condensed by indirect heat exchange with a third liquid taken from at least one third mass exchange region of the lower pressure rectification column and the second liquid being richer in oxygen than the third liquid but less rich in oxygen than the first liquid.

2. The method as claimed in claim 1, in which the impure oxygen product is withdrawn from the lower pressure rectification column in liquid state.

3. The method as claimed in claim 1, in which the first mass exchange region is the bottom one in the lower pressure rectification column.

4. The method as claimed in claim 1, in which the said first liquid is reboiled by indirect heat exchange with a second air stream at a higher pressure than the first air stream, at least part of the second air stream thereby being condensed.

5. The method as claimed in claim 4, wherein the second air stream downstream of its heat exchange with the first liquid is reduced in pressure and introduced into the higher pressure rectification column.

6. The method as claimed in claim 1, in which the said first liquid is reboiled by indirect heat exchange with a second air stream enriched in oxygen, at least part of the second air stream thereby being condensed.

7. The method as claimed in claim 6, in which the second air stream is enriched in oxygen by being mixed in a liquid-vapor contact column with an oxygen-enriched liquid stream withdrawn from the lower pressure rectification column.

8. The method as claimed in claim 7, in which the oxygen-enriched liquid stream is pumped into the liquid vapor contact column.

9. The method as claimed in claim 1, in which a third air stream is introduced into the lower pressure rectification column.

10. The method as claimed in claim 1, in which the air is taken from at least one source of compressed air that has been purified by removal therefrom of water vapor and carbon dioxide and has been cooled to a temperature suitable for its separation by rectification.

11. The method as claimed in claim 1, in which the lower pressure rectification column is operated at a pressure at its bottom of less than 1.5 bar.

12. The method as claimed in claim 1, in which impure liquid oxygen product is vaporized by indirect heat exchange with a stream of compressed air at a higher pressure than the pressure at the bottom of the higher pressure rectification column.

13. The method as claimed in claim 1, in which the said oxygen-enriched fluid is oxygen-enriched liquid taken from a bottom mass exchange region of the higher pressure rectification column.

14. The method as claimed in claim 1, in which the lower pressure rectification column is operated at a pressure at its bottom in the range of 2.5 to 5 bar.

15. The method as claimed in claim 14, in which said oxygen enriched fluid is formed by taking a stream of oxygen-enriched liquid from the higher pressure rectification column, flashing the oxygen-enriched liquid stream through a pressure reducing valve so as to reduce its pressure to a value intermediate the pressure at the bottom of the higher pressure rectification column and the pressure at the bottom of the lower pressure rectification column, partially reboiling the resulting stream, separating resulting liquid and vapor phases, and introducing streams of separated liquid and vapor into the lower pressure rectification column.

16. The method as claimed in claim 15, in which the stream of separated vapor phase is condensed upstream of its introduction into the lower pressure rectification.

17. The method as claimed in claim 15, in which the partial reboiling of the stream resulting from the flashing of the oxygen-enriched liquid stream is performed by indirect heat exchange with nitrogen taken from the higher pressure rectification column, the nitrogen thereby being condensed.

18. An apparatus for separating air comprising:

a higher pressure rectification column for separating a first stream of air into nitrogen vapor and oxygen-enriched liquid;

a condenser for condensing at least some of the nitrogen vapor having an outlet for condensate in communication with an inlet to the higher pressure rectification column for liquid nitrogen reflux;

a lower pressure rectification column for rectifying a stream of oxygen-enriched fluid having a first inlet for the stream of oxygen-enriched fluid, a second inlet for liquid nitrogen reflux and an outlet for impure product oxygen;

a first reboiler for reboiling a first liquid having an inlet for the first liquid in communication with a first mass exchange region of the lower pressure rectification column and an outlet for reboiled first liquid communicating with the lower pressure rectification column whereby a flow of reboiled first liquid upwardly through the lower pressure rectification column;

a second reboiler for reboiling a second liquid by indirect heat exchange with the first stream of air, said second reboiler having an inlet for the second liquid communicating with at least one second mass exchange region of the lower pressure rectification column, an inlet for the first stream of air, and an outlet for reboiled second liquid communicating with the lower pressure rectification column so that a flow of reboiled second liquid is able to pass upwardly through the lower pressure rectification column;

said condenser having reboiling passages having an inlet for a third liquid communicating with at least one third mass exchange region of the lower pressure rectification column; and the communication between the said inlets for the first second and third liquids and respectively the first, second and third mass exchange regions of the lower pressure rectification column is such that in operation the second liquid is richer in oxygen than the third liquid but less rich in oxygen than the first liquid.

19. The apparatus as claimed in claim 18, in which the first mass exchange region is the bottom one in the lower pressure rectification column.

20. The apparatus as claimed in claim 19, in which the first reboiler has an inlet for a second air stream and an outlet for an at least partially condensed second air stream, which outlet communicates with the higher pressure rectification column.

21. The apparatus as claimed in claim 20, additionally including a liquid-vapor contact column for enriching in oxygen the second air stream upstream of the first reboiler.

22. The apparatus as claimed in claim 18, additionally including an outlet from the higher pressure rectification column for an oxygen-enriched liquid stream, a throttling valve for reducing the pressure of the oxygen-enriched liquid stream, a reboiler downstream of the throttling valve for reboiling a part of the pressure-reduced oxygen-enriched liquid stream, a phase separator for separating resulting liquid and vapor streams, the phase separator having an outlet for a liquid stream and an outlet for a vapor stream both communicating with the lower pressure rectification column.

23. The apparatus as claimed in claim 22, additionally including a further condenser for condensing said vapor stream upstream of the lower pressure rectification column.

* * * * *